US009510622B2

(12) United States Patent
Roila et al.

(10) Patent No.: US 9,510,622 B2
(45) Date of Patent: Dec. 6, 2016

(54) PACKET FOR TOBACCO PRODUCTS

(71) Applicant: G.D S.p.A., Bologna (IT)

(72) Inventors: Patrizio Roila, San Mariano di Corciano (IT); Roberto Polloni, Modigliana (IT); Marco Ghini, Monte San Pietro (IT); Stefano Negrini, Calderara di Reno (IT)

(73) Assignee: G.D. S.p.A., Bologna (IT)

( * ) Notice: Subject to any disclaimer, the term of this patent is extended or adjusted under 35 U.S.C. 154(b) by 0 days.

(21) Appl. No.: 14/377,687

(22) PCT Filed: Mar. 5, 2013

(86) PCT No.: PCT/IB2013/051741
§ 371 (c)(1),
(2) Date: Aug. 8, 2014

(87) PCT Pub. No.: WO2013/132430
PCT Pub. Date: Sep. 12, 2013

(65) Prior Publication Data

US 2015/0216228 A1 Aug. 6, 2015

(30) Foreign Application Priority Data

Mar. 7, 2012 (IT) ..... BO2012A0113

(51) Int. Cl.
*A24F 15/00* (2006.01)
*B65D 85/10* (2006.01)
(Continued)

(52) U.S. Cl.
CPC ..... *A24F 15/00* (2013.01); *B65D 5/38* (2013.01); *B65D 5/721* (2013.01); *B65D 17/24* (2013.01);
(Continued)

(58) Field of Classification Search
CPC ..... A24F 15/00; A24F 15/04; A24F 15/06; A24F 15/12; A24F 15/14; A24F 15/16; B65D 5/38; B65D 17/24; B65D 25/108; B65D 65/14; B65D 85/1009; B65D 85/1036; B65D 85/1045; B65D 85/1054
(Continued)

(56) References Cited

U.S. PATENT DOCUMENTS 1,155,688 A * 10/1915 Shearman et al. ..... A24F 23/02 206/255
1,615,545 A * 1/1927 Larson ..... A24F 15/12 206/250
(Continued)

FOREIGN PATENT DOCUMENTS

CN 101277877 A 10/2008
DE 908236 C 4/1954
(Continued)

OTHER PUBLICATIONS

International Search Report and Written Opinion dated Jun. 12, 2013 from counterpart application No. PCT/IB2013/051741.
(Continued)

*Primary Examiner* — Bryon Gehman
(74) *Attorney, Agent, or Firm* — Shuttleworth & Ingersoll, PLC; Timothy Klima

(57) ABSTRACT

A packet for tobacco products includes an inner container housing a group of tobacco products. A bottom wall is positioned at end portions of the tobacco products. An outer container houses the inner container slidably in parallel with axes of the tobacco products, thus allowing the inner container to slide between a retracted position, and an extracted or raised position. The bottom wall of the inner container forms a supporting portion abutting the end portion of one of the tobacco products. The top wall of the outer container includes an opening, and each sliding action of the inner
(Continued)

container towards the raised position causes an axial movement towards the top wall of the outer container of the tobacco product abutting the supporting portion and causing a pickup portion of the tobacco product to come out through the opening in the outer container.

9 Claims, 6 Drawing Sheets

(51) Int. Cl.

| | |
|---|---|
| ***B65D 5/72*** | (2006.01) |
| ***B65D 5/38*** | (2006.01) |
| ***B65D 17/00*** | (2006.01) |
| ***B65D 25/10*** | (2006.01) |
| ***B65D 65/14*** | (2006.01) |

(52) U.S. Cl.
CPC ..... *B65D 25/108* (2013.01); *B65D 65/14* (2013.01); *B65D 85/1009* (2013.01); *B65D 85/1036* (2013.01)

(58) Field of Classification Search
USPC ..... 206/249, 250, 252, 254, 255
See application file for complete search history.

(56) References Cited

U.S. PATENT DOCUMENTS

| | | | | |
|---|---|---|---|---|
| 1,648,074 | A | 11/1927 | Sticht | |
| 1,807,936 | A * | 6/1931 | Saunders | A24F 15/12 206/250 |
| 1,897,702 | A * | 2/1933 | Lewnes | A24F 15/14 206/255 |
| 1,995,556 | A | 3/1935 | Zayas | |
| 2,929,542 | A * | 3/1960 | O'Gorman | B65D 85/1054 206/268 |
| 3,108,711 | A | 10/1963 | Anton | |
| 4,534,463 | A | 8/1985 | Bouchard | |
| 4,559,758 | A | 12/1985 | Gamberini | |
| 4,789,059 | A | 12/1988 | Kim | |
| 5,080,227 | A | 1/1992 | Focke | |
| 5,205,402 | A * | 4/1993 | Maeda | A24F 15/14 206/250 |
| 6,450,329 | B1 | 9/2002 | Draghetti et al. | |
| 7,721,881 | B2 * | 5/2010 | He | B65D 85/1009 206/249 |
| 7,726,473 | B2 | 6/2010 | Miyazawa et al. | |
| 7,992,708 | B2 * | 8/2011 | Hein | B65D 85/1054 206/249 |
| 8,225,931 | B2 | 7/2012 | Wharton | |
| 8,584,844 | B2 | 11/2013 | Tearle | |
| 2008/0185303 | A1 | 8/2008 | He | |
| 2009/0038966 | A1 | 2/2009 | Ghini et al. | |
| 2011/0232236 | A1 | 9/2011 | Chatelain et al. | |
| 2013/0140201 | A1 | 6/2013 | Ghini et al. | |
| 2013/0248392 | A1 | 9/2013 | Roila et al. | |

FOREIGN PATENT DOCUMENTS

| | | | |
|---|---|---|---|
| FR | 2499947 | A3 | 8/1982 |
| FR | 2876664 | A1 | 4/2006 |
| GB | 322152 | A | 11/1929 |
| IT | 111169163 | B | 5/1987 |
| JP | 248391 | | 12/1990 |
| WO | 2004063032 | A2 | 7/2004 |
| WO | 2012025757 | A1 | 3/2012 |

OTHER PUBLICATIONS

International Search Report and Written Opinion dated Jun. 12, 2013 from counterpart App No. PCT/IB2013/051708.
Office Action issued by the State Intellectual Property Office of the People's Republic of China dated Nov. 2, 2015 for counterpart Chinese application No. 201380012543.9.

* cited by examiner

PACKET FOR TOBACCO PRODUCTS

This application is the National Phase of International Application PCT/IB2013/051741 filed Mar. 5, 2013 which designated the U.S. and that International Application was published under PCT Article 21(2) in English.

This application claims priority to Italian Patent Application No. BO2012A000113 filed Mar. 7, 2012, which application is incorporated by reference herein.

TECHNICAL FIELD

This invention relates to a packet for tobacco products with facilitated extraction of the tobacco products.

Hereinafter in this description, reference is made to tobacco products consisting of cigarettes, without thereby restricting the scope of the invention.

BACKGROUND ART

Several types of cigarette packets present on the market, or not yet on the market but described and illustrated in patent documents, have an outer container which houses an inner container which accommodates a group of cigarettes.

In many cases, the inner container is initially closed and has an upper portion which can be torn off and removed the first time the packet is opened in order to take out the cigarettes inside it.

Often, the inner container applies a certain amount of lateral compression on the group of cigarettes inside it. When the cigarette packet is new, that is to say, when the group of cigarettes it contains is whole, the lateral compression applied to the group of cigarettes may be relatively high and may make it quite difficult to take out the first cigarette from the group of cigarettes owing to the friction between the first cigarette itself and the cigarettes around it.

One solution which has been proposed to make it easier to take out the first cigarette, and if necessary also other cigarettes, from the group, is to couple to at least one cigarette in the group a pull-out tape with one end which protrudes from the top wall of the group of cigarettes and which is designed to be gripped and pulled in order to lift out the cigarette.

These prior art pull-out tapes, however, usually require the inner end of them, opposite the end to be gripped, to be glued to one wall of the inner container. This constitutes a major disadvantage since the inner wrappings of cigarette packets have always been left free of glue because glue in contact with or close to the cigarettes may give off volatile substances which are absorbed by the cigarettes and cause an unwanted alteration of the flavour and/or taste of the cigarette tobacco.

DISCLOSURE OF THE INVENTION

This invention has for an aim to provide a packet for tobacco products which overcomes the above mentioned disadvantages and which is at once easy and inexpensive to make.

The invention accordingly provides a packet for tobacco products as described in the appended claims.

BRIEF DESCRIPTION OF DRAWINGS

The invention is described below with reference to the accompanying drawings, which illustrate a non-limiting embodiment of it, and in which.

DETAILED DESCRIPTION OF THE PREFERRED EMBODIMENTS OF THE INVENTION

Figure 1:
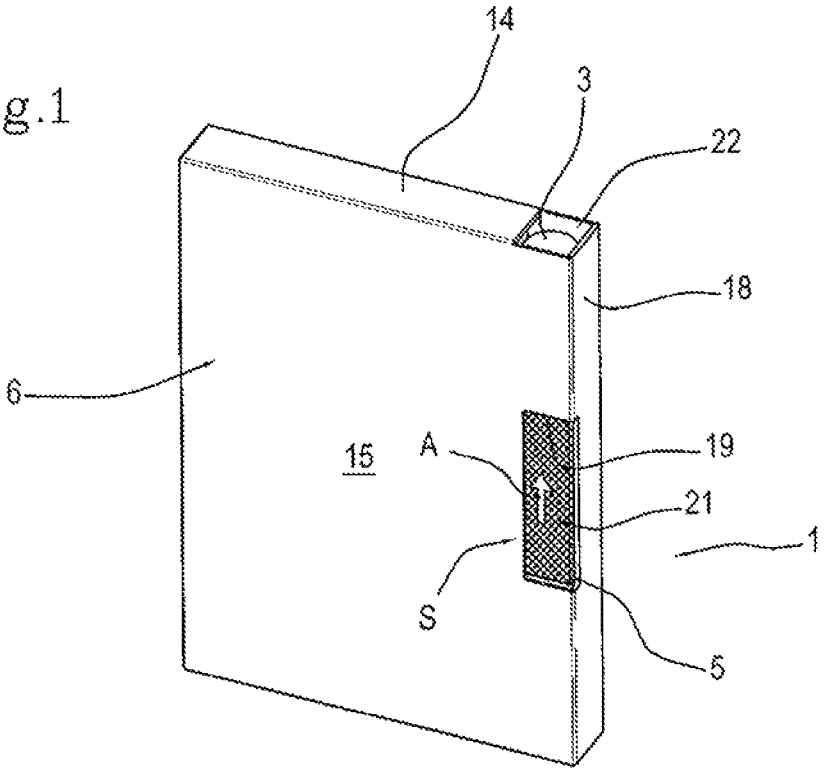
FIGS. 1 and 2 are perspective views of a packet for tobacco products according to this invention, in two different working situations.
Figure 2:
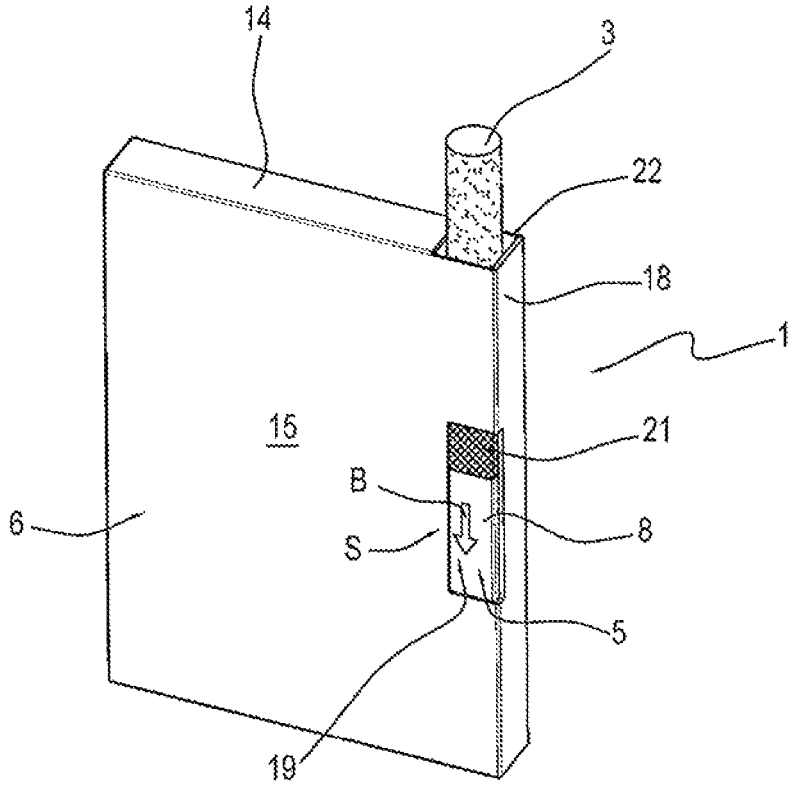

The numeral 1 in FIGS. 1 and 2 denotes in its entirety a packet for tobacco products. Preferably, the packet 1 is a cigarette packet and, in the description which follows, reference is made to a cigarette packet, for brevity, but without thereby limiting the scope of the invention.

Figure 3:
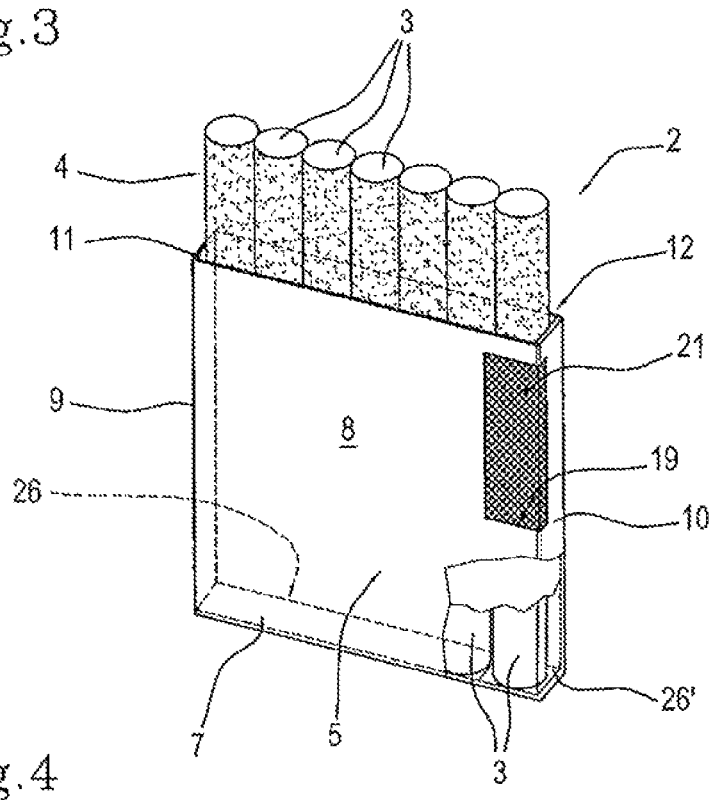
FIGS. 3 and 4 are perspective views of two containers, respectively inner and outer forming part of the packet of FIGS. 1 and 2.

The cigarette packet 1 comprises a group 2 of cigarettes 3 (see also FIG. 3), consisting preferably of a row 4 of cigarettes 3 parallel with each other, positioned side by side in pairs and aligned to form a row in which the cigarettes 3 themselves, when the packet 1 is in use to allow one cigarette 3 to be taken out of it, are positioned with their axes vertical. The cigarettes 3 might also be positioned side by side in two or more rows 4 and they each comprise, at the ends of them, a pickup portion which can be manually gripped and an end portion opposite the pickup portion.

In the description which follows, the term "vertical" (and similar terms) will be used, for explanatory purposes, to describe the position adopted by the packet 1 when the cigarettes inside it, for easier extraction, are positioned with their axes vertical and the zone where the cigarettes 3 themselves are extracted from the packet 1 is located at the top of the packet 1. Similarly, the terms "upper" and "lower" (and like terms, such as "top" and "bottom") will be used to designate the corresponding portions of the packet 1 when it is in the vertical position.

The group 2 of cigarettes 3 is contained in a hard inner container 5 which is housed in such a way that it can slide within a hard outer container 6, made of cardboard or the like, vertically in both directions with a straight vertical movement between a retracted position (illustrated in FIG. 1), where the inner container 5 is at its lowermost position inside the outer container 6 and a raised or cigarette extraction position (illustrated in FIG. 2), where the inner container 5 is at its uppermost position inside the outer container 6 and keeps one cigarette 3 in a partly extracted position (upwardly) from the inner container 5.

The inner container 5 (FIG. 3) has the shape of a parallelepiped, with a substantially "cupped" form, and has a bottom wall 7, two parallel larger side walls 8, which are parallel and opposite to one another, and two smaller parallel side walls 9 and 10, which are interposed between the larger side walls 8. The open upper end 11 of the inner container 5 defines, in the proximity of the smaller side wall 10, a zone 12 for extracting one cigarette 3 at a time and through which, when the inner container 5 is in the "raised" position (whose features and purposes are described below) it is possible to extract a cigarette 3 from the packet 1.

Figure 4:
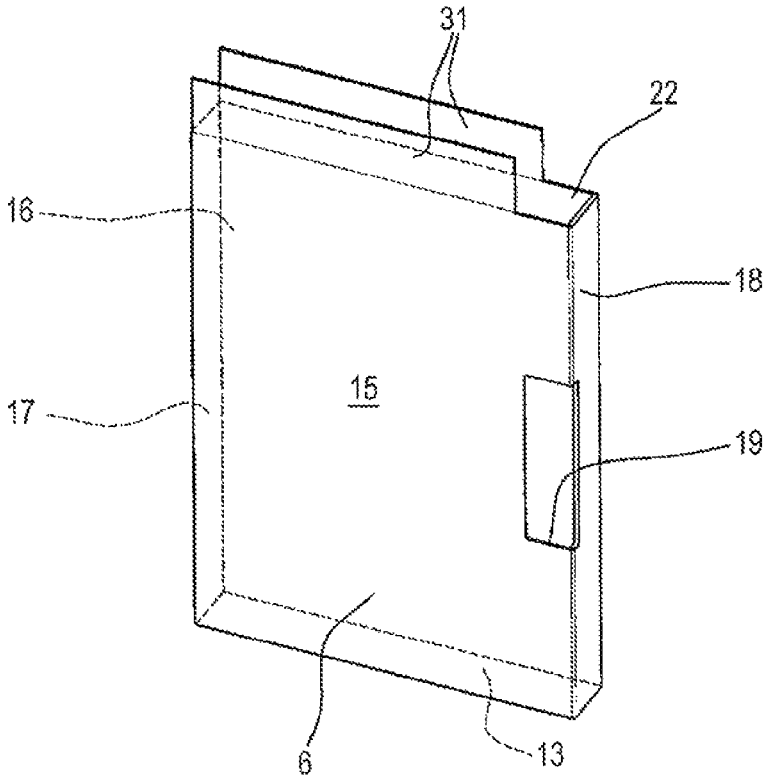

As illustrated, in particular in FIG. 4, the outer container 6 also has the shape of a parallelepiped and has a bottom wall 13, a top wall 14, two larger side walls 15 and 16 which are parallel and opposite to each other and which are located, in FIG. 4, at the front and back, respectively, and two smaller side walls 17 and 18 (which are positioned on the left and on the right, respectively).

In a zone substantially half way along the edge where the side walls 15 and 18 of the outer container 6 meet, there is an opening comprising a slot 19 made in the blank 20 which makes up the outer container 6 itself and through which a smoker can touch a front zone 21 of the inner container 5. The shape and size of the slot 19 are such as to allow the smoker to apply, through the slot 19 itself, a pushing action on the front zone 21 of the inner container 5 in such a way as to move it vertically in both directions, making it slide within the outer container 6 between the aforementioned retracted and raised positions. It should be noted that in variant embodiments, not illustrated, of the packet 1, the slot 19 might be made in only one of the larger side walls 15 (preferably the front one), or one of the smaller side walls 18.

In order to facilitate the manual pushing action applied by the smoker on the front zone 21 of the inner container 5, the exposed surface of the front zone 21 may be provided with knurling or other roughening feature.

The upper wall 14 of the outer container 6 has an opening 22 which is substantially square in shape, vertically aligned with the zone 12 for extracting the cigarettes 3 and therefore placed substantially over a lateral end portion of the inner container 5 on the right-hand side in FIGS. 1 and 2 and facing the slot 19 of the outer container 6.

Figure 5:
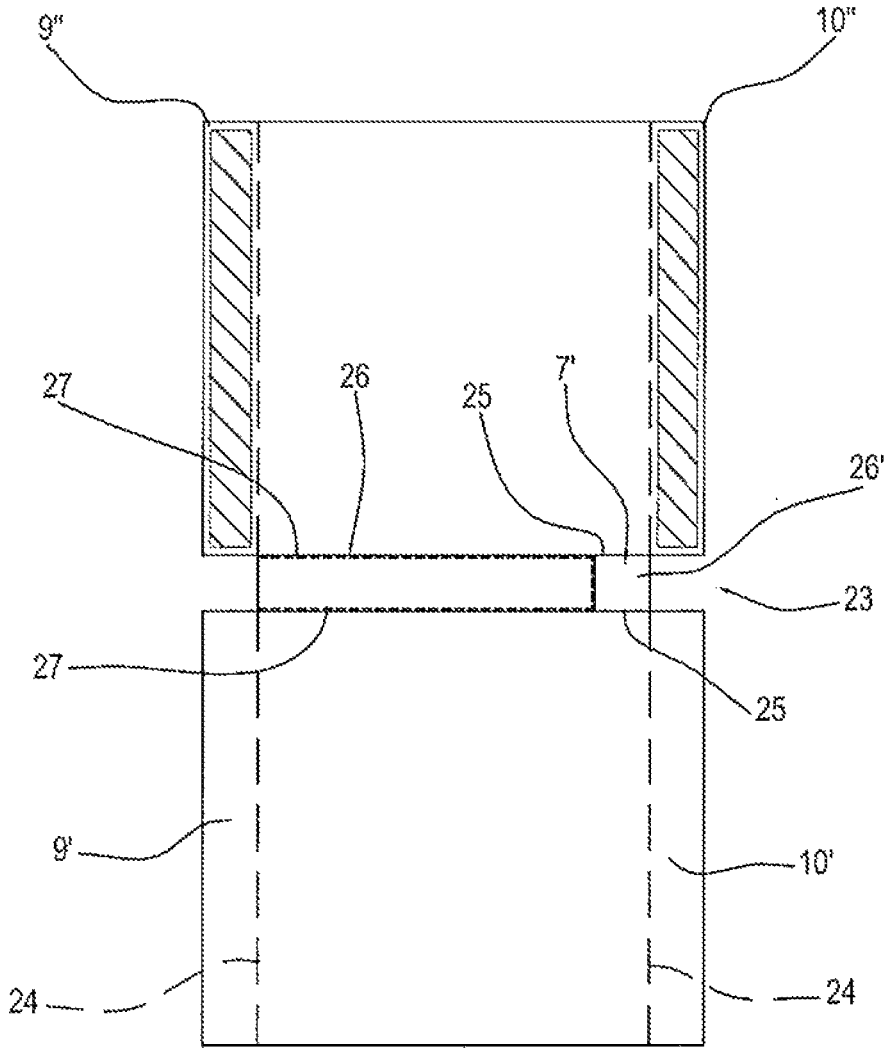
FIGS. 5 and 6 are respective plan views of two blanks used to make the packet for tobacco products of FIGS. 3 and 4.
Figure 6:
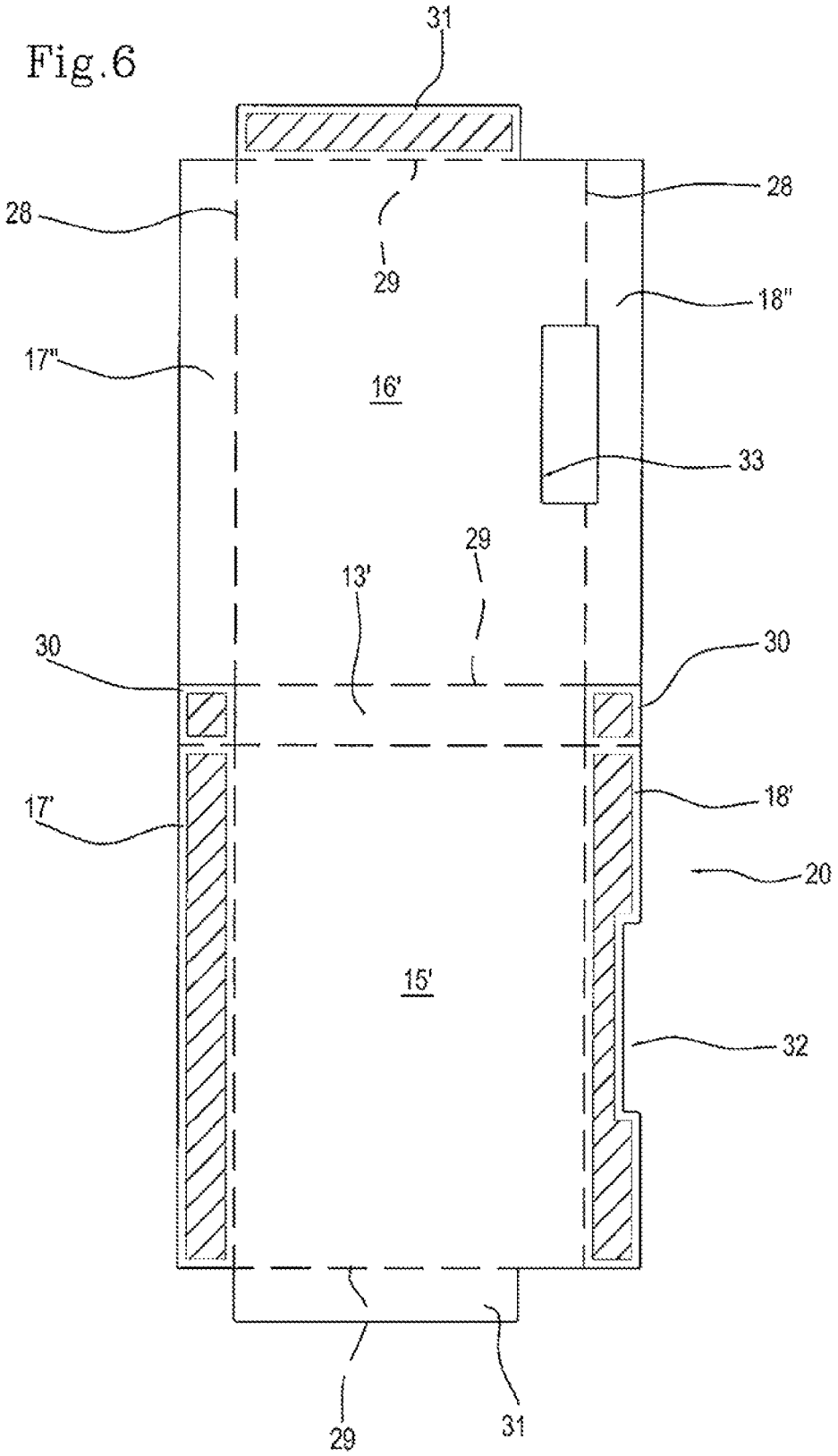

The containers 5 and 6 of the cigarette packet 1 are obtained from corresponding blanks 23 and 20, respectively, illustrated in FIGS. 5 and 6, respectively. Each of the blanks 23 and 20 comprises a plurality of elements, which, where possible, are denoted by primed reference numerals which are the same as the unprimed reference numerals denoting the corresponding elements of the respective container 5 or 6.

With reference to FIG. 5, the blank 23 has two longitudinal lines of weakness 24 and two transversal lines of weakness 25 which define (from the bottom up in the figure), between the two longitudinal lines of weakness 24, a panel 8' constituting one larger side wall 8, a panel 7' constituting the bottom wall 7 and a panel 8' constituting the other larger side wall 8.

The panel 8", located at the bottom in FIG. 5, has a pair of side flaps 9', 10', left and right, respectively, which constitute an inner part of the smaller side walls 9, 10', are located on opposite sides of the panel 8' adjacent to them and are separated from the panel 8' by the longitudinal lines of weakness 24. Similarly, the panel 8', located at the top in FIG. 5, has a pair of side flaps 9", 10", left and right, respectively, which constitute an outer part of the smaller side walls 9, 10', are located on opposite sides of the panel 8' adjacent to them and are separated from the panel 8' by the longitudinal lines of weakness 24.

The panel 7' constituting the bottom wall 7, is provided, on the part of it on the left in FIG. 5, with a line of weakness 26 which is substantially in the shape of a "U" with concavity facing towards the left and having two opposite long sides 27 coinciding with respective portions of the two longitudinal lines of weakness 25 which delimit two opposite sides of the panel 7' itself.

The line of weakness 26 extends towards the right of the panel 7' to a distance from that end which is just a little longer than the diameter of a cigarette 3. The portion of the panel 7' between the right-hand end of the panel 7' itself and the line of weakness 26 will hereinafter be referred to as "supporting portion", denoted by the reference numeral 26'.

With reference to FIG. 6, the blank 20 has two longitudinal lines of weakness 28 and a plurality of transversal lines of weakness 29 which define (from the bottom up in the figure), between the two longitudinal lines of weakness 29, a panel 15' constituting one larger side wall 15, a panel 13' constituting the bottom wall 13 and a panel 16' constituting the other larger side wall 16.

The panel 15 has a pair of side flaps 17' and 18', left and right, respectively, in FIG. 6, which are located on opposite sides of the panel 15' itself, are separated from the panel 15' by the longitudinal lines of weakness 28, are substantially rectangular in shape and constitute an outer portion of the walls 17 and 18. respectively. Similarly, the panel 16' has a pair of side flaps 17" and 18", left and right, respectively, in FIG. 6, which are located on opposite sides of the panel 16', are separated from the panel 16' itself by the longitudinal lines of weakness 28, are substantially rectangular in shape and constitute an inner portion of the walls 17 and 18, respectively. The horizontal sides of the side flaps 17' and 18' located at the top in FIG. 6 are connected, by end portions of the transversal line of weakness 29 which separates the panel 13' from the panel 15', to two flaps 30 extending towards, and almost touching, the flaps 17" and 18". respectively. Each of the panels 15' and 16' has a horizontal side, located respectively at the bottom and top in FIG. 6, and connected to a respective flap 31 located on the opposite side with respect to the panel 13' and separated from the respective panel 15', 16' by a transversal line of weakness 29.

The transversal dimension of the flaps 31 in the direction of the transversal lines of weakness 29 is smaller than the transversal dimension of the panels 15' and 16', and the flaps 31 are positioned relative to the respective panels 15' and 16' in such a way that they are clear of respective lateral portions of the panels 15' and 16' situated on the right in FIG. 6 and whose width is just larger than the diameter of a cigarette 3.

The side flap 18' connected to the edge of the panel 15' situated on the right in FIG. 6 is provided, at a longitudinally median zone of it, with a recess 32 which runs parallel to the longitudinal direction of extension of the blank 20 and whose depth is substantially equal to half the width of the flap 18' itself.

The zone of connection between the panel 16' and the side flap 18" situated on the right in FIG. 6 is crossed at a longitudinally median part of it, by a substantially rectangular elongate slot 33 which runs parallel to the longitudinal direction of extension of the blank 20, whose length is substantially equal to that of the recess 32 and whose width, at the portion of it corresponding to the side flap 18", is equal to that of the recess 32, whilst at the portion of it situated on the panel 16' is preferably greater than the width of the recess 32, being substantially equal to 7-10 mm.

It should be noted that in variant embodiments of the invention not illustrated, the slot 33 might be situated at any position on the panel 16', and it might be of any shape and size, in any case different from the shape and size of the slot 33 shown in FIG. 6.

In the blanks 20 and 23 shown in FIGS. 5 and 6, the parts where glue must be applied in order to assemble the containers 5 and 6 are represented as hatched areas.

The inner container 5 is assembled by folding the panels 8' squarely relative to the panel 7', towards each other, about the transversal lines of weakness 25 which join them to the panel 7' itself. The side flaps 9' and 10' are then folded squarely about the longitudinal lines of weakness 24 which join them to the panel 8', in such a way that they cover the space between the two panels 8', and the side flaps 9" and 10" are in turn folded squarely over the respective side flaps 9' and 10' which, have already been folded. The glue on the blank 23, as specified above, keeps the inner container 5 in the shape thus obtained.

The outer container 6 is assembled in a similar way to the inner container 5, since the panels 15' and 16' are folded squarely about the transversal lines of weakness 29 which join them to the panel 13', the side flaps 17" and 18" are folded squarely about the longitudinal lines of weakness 28, which join them to the panel 16', in such a way that they cover the space between the two panels 16', the flaps 30 are folded squarely about the transversal lines of weakness 29, which join them to the respective flaps 17' and 18', and are placed over the panel 13', and the side flaps 17' and 18' are folded squarely over the respective side flaps 17" and 18" which have already been folded. These operations are performed by shaping the outer container 6 around the inner container 5 already erected and housing inside it a row 4 of cigarettes When the outer container 6 has been completed, the flaps 31 are folded squarely over each other in such a way as to close the outer container 6. The glue on the blank 20, as specified above, keeps the outer container 6 in the shape thus obtained.

It should be noted that on the face of it which is on the outside of the inner container 5, the portion of the panel 7' of the inner container 5 enclosed within the line of weakness 26 is provided with glue which, after the containers 5 and 6 have been assembled, causes it to adhere to the panel 13' of the outer container 6.

As a result, the blank 23 is easy to handle while the inner container 5 is being made, since its bottom panel 7' connects the panels 8' to each other for as long as the line of weakness 26 remains intact, thus giving the blank 23 good shape stability and sufficient rigidity. Once the packet 1 has been completed, the first time the inner container 5 is made to slide upwards within the outer container 6, as mentioned above and as will be explained in more detail below, the line of weakness 26 is torn, the inner container 5 comes completely free of the outer container 6 and the walls 8 of the inner container 5 remain connected to each other only by the zone of the panel T outside of the line of weakness 26. From this moment on, the inner container 5 is open at the bottom except only the zone of the panel 7' outside the line of weakness 26, that is to say, except the supporting portion 26' of the wall 7.

In other words, according to the above, the bottom wall of the inner container 5 is defined by a bottom wall 7 in which a tearable line of weakness 26 is made which delimits an area of the selfsame bottom wall 7. A portion of the bottom wall 7 outside that area defines the supporting portion 26' and the area is connected by adhesive to the bottom wall 13 of the outer container 6.

In use, when a cigarette 3 does not need to be taken out, the inner container 5 must occupy its lowermost retracted position where its bottom wall 7 is in contact with the bottom wall 13 of the outer container 6. Under these conditions, and if the packet 1 is positioned with the row 4 of cigarettes 3 lying in a substantially vertical plane and with the axes of the cigarettes 3 horizontal, the cigarettes 3 inside the inner container 5 are capable of sliding translationally towards the wall 10 of the inner container 5 perpendicularly to their axes. As a result of this sliding, the cigarette 3 closest to the wall 10 of the inner container 5 moves above the zone of the wall adjacent to the wall 10 itself, that is to say, above the supporting portion 26'.

To take a cigarette 3 out of the packet 1, all the smoker has to do is press a finger on the front zone 21 of the inner container 5 through the slot 19 of the outer container 6 in such a way as to urge the inner container 5 upwards from the retracted position to the raised position and to cause an upper portion of the cigarette 3 resting on the supporting portion 26' of the wall 7 to protrude through the opening 22 of the top wall 14 of the outer container 6.

As specified above, since the bottom of the inner container 5 is open except for the supporting portion 26' of the wall 7, the other cigarettes 3 in the row 4 remain in the lowered position in contact with the bottom wall 13 of the outer container 6.

Once the cigarette 3 protruding partly from the packet 1 has been taken out, the inner container 5 must be returned to the initial retracted position by pressing a finger on the front zone 21 in order to allow another cigarette 3 to move onto the supporting portion 26' of the wall 7, as described above.

Figure 7:
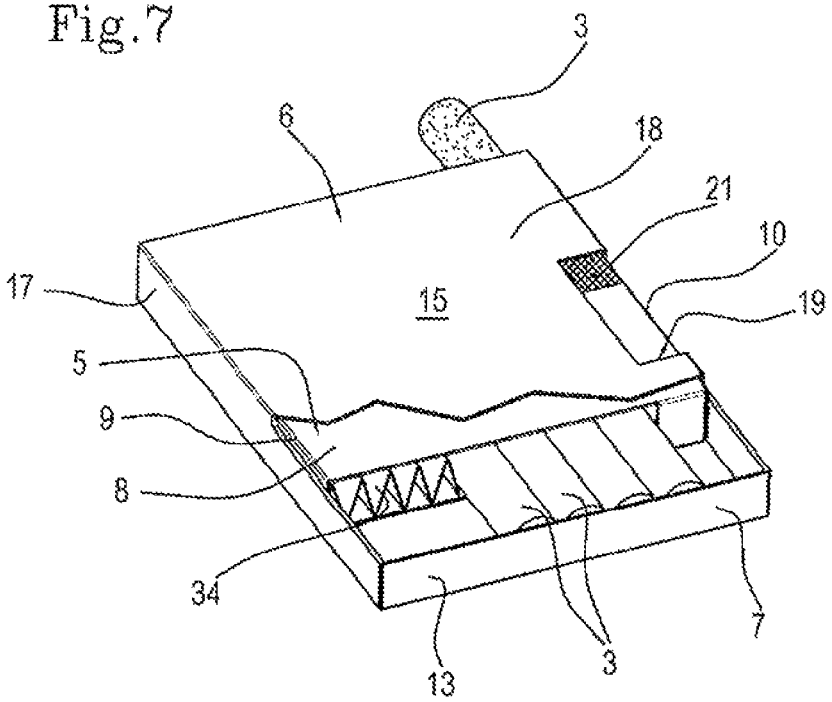
FIG. 7 is a perspective view of a variant embodiment of the packet of the preceding figures.

FIG. 7 shows an inner container 5 in which the sliding of the cigarettes 3 towards the wall 10 after a cigarette 3 has been taken out and the return of the inner container 5 to the initial retracted position are facilitated by an elastic element 34 comprising a spring made (for example) by zigzag folding a sheet consisting (for example) of paperboard or plastic material and capable of urging the cigarettes 3 inside the inner container 5 transversely towards the wall 10, that is to say, towards the zone of action of the supporting portion 26'.

Figure 8:
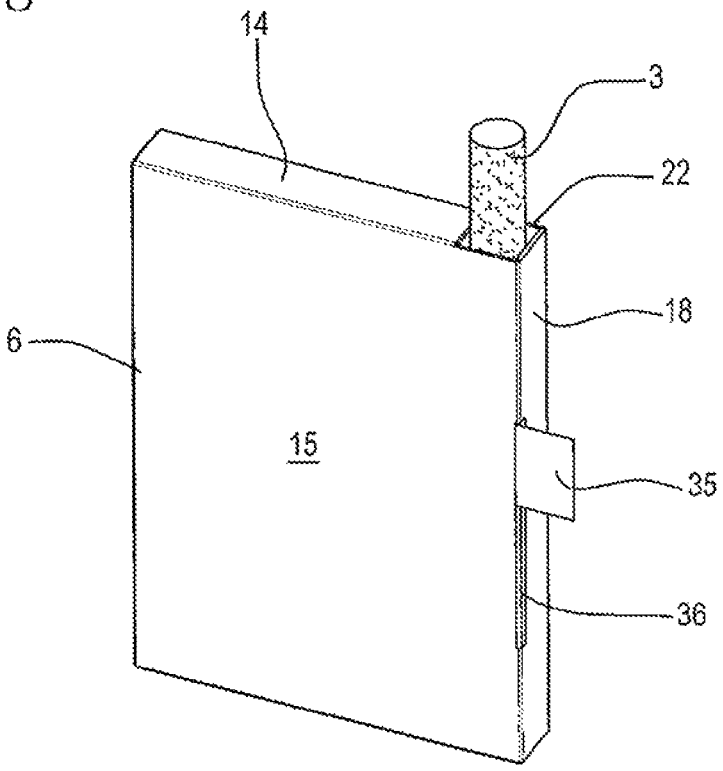
FIG. 8 is a perspective view of a further variant embodiment of the packet of the preceding figures.
Figure 9:
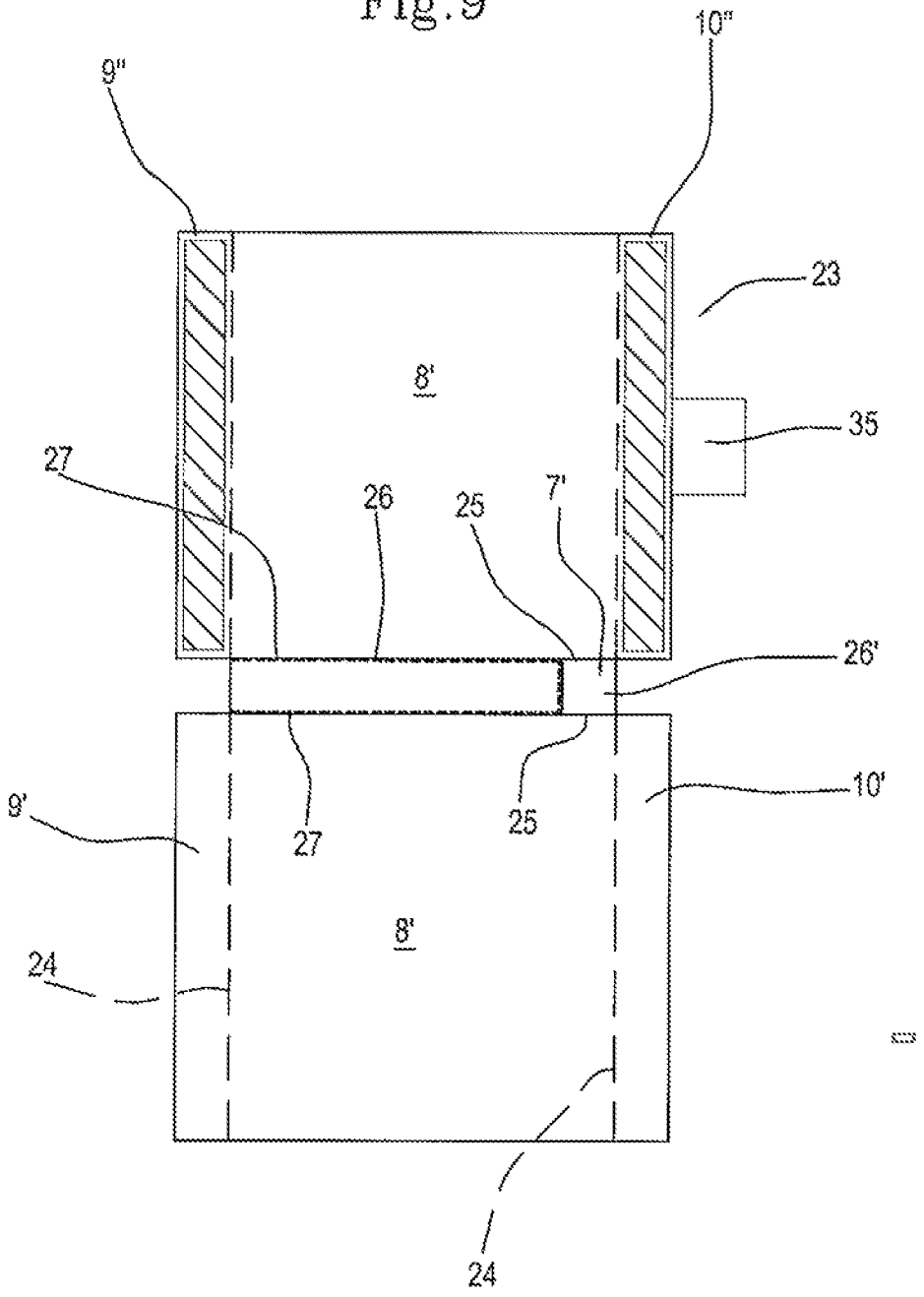
FIG. 9 is a plan view of a blank used to make the packet for tobacco products of FIG. 8.

FIG. 8 shows a further variant embodiment of the packet 1, where the sliding of the inner container 5 in both directions between the initial retracted position and the raised position is caused by pulling up or down a grip element comprising a tab 35 which, as shown also in FIG. 9, is integral with a lateral edge of the flap 10' of the blank 23 of the inner container 5 itself and which, in the packet 1, comes out of the outer container 6 through an opening comprising a vertical slit 36 made in the respective blank 20.

It should be noted that in a variant embodiment of the invention not illustrated, the supporting portion 26' and the extraction zone 12 might be of a size, measured along the longitudinal direction of extension of the panel 7', substantially equal to a multiple of the diameter of a cigarette 3. In this case, the upward movement of the inner container 5 would cause the upper portions of two or more cigarettes 3 to come out through the zone 12. After taking out one of these cigarettes 3, the smoker would re-lower the inner container 5, thereby causing the remaining, partly protruding cigarettes 3 to return into the outer container 6.

In a further variant embodiment not illustrated, the cigarettes 3 inside the inner container 5 might also be arranged in two or more rows side by side, instead of in a single row 4. In this case, too, the supporting portion 26' might have two or more cigarettes 3 on it, side by side, the upward movement of the inner container 5 would cause the upper portions of two or more cigarettes 3 to come out through the zone 12 and after taking cut one of these cigarettes 3, the smoker would re-lower the inner container 5, thereby causing the remaining, partly protruding cigarettes 3 to return into the outer container 6.

In a yet further embodiment, the above mentioned knurling on the wall 8 of the inner container 5 might be accompanied by or substituted for graphic signs S (shown only in FIGS. 1 and 2) which indicate to the smoker how to extract the cigarettes 3 through the opening 22 and how to load them one after another on the supporting portion 26'.

The graphic signs S are preferably defined by an arrow A (FIG. 1) pointing towards the extraction zone 12 and indicating the direction in which the inner container 5 must be made to slide in order to extract the cigarettes 3 and a second arrow B (FIG. 2), pointing in the opposite direction to the arrow A and indicating the direction in which the inner container 5 must be made to slide in order to load the next cigarette 3 on the supporting portion 26'.

The arrows A and B are visible alternately through the slot 19 of the outer container 6. More specifically, when the inner container 5 is at the lowered position inside the outer container 6 (FIG. 1), only the arrow A is visible and the arrow B is hidden by the outer container 6. When the inner container 5 is moved to the raised position, the arrow A is hidden by the outer container 6 and the arrow B is visible through the slot 19.

The invention claimed is:

1. A packet for tobacco products with facilitated extraction of the tobacco products, comprising:

an inner container substantially having the shape of a parallelepiped, housing a group of elongate tobacco products which are positioned side by side in at least one row and each comprising a first end portion which is manually grippable and a second end portion opposite the first end portion, the container also comprising a bottom wall positioned at the second end portions of the tobacco products; and an outer container having the shape of a parallelepiped, housing the inner container slidably in parallel with respective axes of the tobacco products, thus allowing the inner container to slide between a retracted position, in which the inner container has its bottom wall adjacent to a bottom wall of the outer container and all of the tobacco products are completely contained in the inner container, and an extracted or raised position, in which the inner container is positioned close to a top wall of the outer container;

the bottom wall of the inner container forming a supporting portion designed to abut the second end portion of at least one of the tobacco products present in the inner container;

the top wall of the outer container comprising an opening;

and each sliding action of the inner container towards the extracted or raised position in practice causing an axial movement towards the top wall of the outer container of the at least one of the tobacco products abutting the supporting portion and causing a pickup portion of the least one of the tobacco products to come out through the opening in the outer container, wherein the supporting portion has a width smaller than a width of a larger side wall of the inner container, and remaining portion of the base of the inner container, which is occupied by the second end portion, is attached to the bottom wall of the outer container to allow the tobacco products, which do not abut the supporting portion to be positioned against the bottom wall of the outer container;

wherein the bottom wall of the inner container is formed by a wall in which there is a weakened line which can be torn, delimiting an area of the lower wall; a portion of the lower wall which is outside the area forming the supporting portion, and the area being connected by adhesive to the lower wall of the outer container.

2. The packet for tobacco products according to claim 1, wherein the outer container includes a further opening through which a smoker can manually act on the inner container to cause sliding actions of the inner container between the retracted position and the extracted or raised position.

3. The packet for tobacco products according to claim 2, wherein the further opening is made in a substantially middle zone of the edge which joins one larger lateral wall and one smaller lateral wall of the outer container.

4. The packet for tobacco products according to claim 2, wherein the further opening is made in a larger lateral wall of the outer container.

5. The packet for tobacco products according to claim 2, wherein the further opening is made in a smaller lateral wall of the outer container.

6. The packet for tobacco products according to claim 2, and further comprising a grip element integral with the inner container and coming out of the outer container through the further opening.

7. The packet for tobacco products according to claim 6, wherein the grip element comprises a tab integral with the inner container; the further opening comprising a vertical slit made in the outer container.

8. The packet for tobacco products according to claim 1, wherein the inner container houses an elastic element designed to push the tobacco products transversally towards the supporting portion.

9. The packet for tobacco products according to claim 1, wherein the inner container comprises graphical symbols which indicate to a smoker how to extract the tobacco products through the opening in the outer container and how to load the tobacco products one after another on the supporting portion.

* * * * *